US009581160B2

(12) United States Patent
Iitsuka et al.

(10) Patent No.: US 9,581,160 B2
(45) Date of Patent: Feb. 28, 2017

(54) SCROLL COMPRESSION DEVICE

(75) Inventors: Satoshi Iitsuka, Gunma-ken (JP); Tsutomu Kon, Gunma-ken (JP); Akihiro Hayashi, Gunma-ken (JP); Katsuki Akuzawa, Gunma-ken (JP); Kenji Aida, Gunma-ken (JP); Kazuyoshi Sugimoto, Gunma-ken (JP); Yasunori Kiyokawa, Gunma-ken (JP); Yoshihiko Nagase, Gunma-ken (JP); Yoshiaki Nagasawa, Gunma-ken (JP)

(73) Assignee: Panasonic Intellectual Property Management Co. Ltd., Osaka-shi, Osaka (JP)

( * ) Notice: Subject to any disclaimer, the term of this patent is extended or adjusted under 35 U.S.C. 154(b) by 577 days.

(21) Appl. No.: 14/007,157

(22) PCT Filed: Dec. 20, 2011

(86) PCT No.: PCT/JP2011/079464

§ 371 (c)(1),
(2), (4) Date: Oct. 17, 2013

(87) PCT Pub. No.: WO2012/127750

PCT Pub. Date: Sep. 27, 2012

(65) Prior Publication Data

US 2014/0044572 A1 Feb. 13, 2014

(30) Foreign Application Priority Data

Mar. 24, 2011 (JP) ..... 2011-065607
Mar. 25, 2011 (JP) ..... 2011-066920
(Continued)

(51) Int. Cl.
*F04C 23/02* (2006.01)
*F04C 18/02* (2006.01)
(Continued)

(52) U.S. Cl.
CPC ..... *F04C 23/02* (2013.01); *F04C 18/0207* (2013.01); *F04C 18/0215* (2013.01);
(Continued)

(58) Field of Classification Search
CPC .... F04C 23/02; F04C 29/026; F04C 29/0078; F04C 18/0207; F04C 23/008; F04C 29/028; F04C 18/0215
See application file for complete search history.

(56) References Cited

U.S. PATENT DOCUMENTS 4,496,293 A 1/1985 Nakamura et al.
5,873,710 A * 2/1999 Tucker ..... 417/410.5
(Continued)

FOREIGN PATENT DOCUMENTS

CN 1480695 A 3/2004
CN 1550669 A 12/2004
(Continued)

OTHER PUBLICATIONS

International Search Report dated Mar. 19, 2012, issued in corresponding application No. PCT/JP2011/079464.
(Continued)

*Primary Examiner* — Devon Kramer
*Assistant Examiner* — Lilya Pekarskaya
(74) *Attorney, Agent, or Firm* — Westerman, Hattori, Daniels & Adrian, LLP

(57) ABSTRACT

A scroll compression mechanism 11 for compressing refrigerant and a driving motor 13 that drives the scroll compression mechanism 11 are accommodated in a casing 3, the scroll compression mechanism 11 is supported in the casing 3 by a main frame 21, the driving shaft 15 is connected to a rotor 39 of the driving motor 13 and supported in the casing 3 by a bearing plate 8, a pickup 45 is connected to an oil supply path 41 extending in an up-and-down direction in
(Continued)

the driving shaft 15, and intercommunication paths 38B, 54A through which lubrication oil scraped up by the pickup 45 and supplied to respective lubrication sites is returned to the lower side of the driving motor 13 are provided between the stator 37 and the spacer ring 38 or between the spacer ring 38 and the casing 3.

2 Claims, 2 Drawing Sheets

(30) Foreign Application Priority Data

Mar. 25, 2011 (JP) ..... 2011-066921
Mar. 25, 2011 (JP) ..... 2011-067051

(51) Int. Cl.
*F04C 23/00* (2006.01)
*F04C 29/02* (2006.01)
*F04C 29/00* (2006.01)

(52) U.S. Cl.
CPC ..... *F04C 23/008* (2013.01); *F04C 29/0078* (2013.01); *F04C 29/026* (2013.01); *F04C 29/028* (2013.01); *F04C 29/0085* (2013.01)

(56) References Cited

U.S. PATENT DOCUMENTS

| | | | | |
|---|---|---|---|---|
| 6,896,493 | B2 * | 5/2005 | Chang et al. | 417/410.5 |
| 2004/0040323 | A1 | 3/2004 | Yokozeki et al. | |
| 2004/0197213 | A1 * | 10/2004 | Takemoto | 417/410.1 |
| 2005/0086960 | A1 | 4/2005 | Yokozeki et al. | |
| 2005/0210663 | A1 | 9/2005 | Ishida et al. | |
| 2006/0099086 | A1 | 5/2006 | Morozumi et al. | |
| 2008/0298986 | A1 | 12/2008 | Ishida et al. | |
| 2009/0238704 | A1 * | 9/2009 | Sakamoto | F04C 18/0215 418/55.1 |
| 2010/0215533 | A1 * | 8/2010 | Kiyokawa | F04C 23/008 418/55.1 |
| 2010/0215534 | A1 * | 8/2010 | Kiyokawa | F04C 18/0253 418/55.1 |
| 2012/0007455 | A1 | 1/2012 | Tanaka | |

FOREIGN PATENT DOCUMENTS

| | | | |
|---|---|---|---|
| CN | 1638241 | A | 7/2005 |
| CN | 1698249 | A | 11/2005 |
| CN | 101145716 | A | 3/2008 |
| EP | 1 956 244 | A2 | 8/2008 |
| EP | 1 956 244 | A3 | 10/2008 |
| EP | 2416013 | A1 | 2/2012 |
| JP | 55-46081 | A | 3/1980 |
| JP | 57-212389 | A | 12/1982 |
| JP | 58-165907 | A | 10/1983 |
| JP | 59-29785 | A | 2/1984 |
| JP | 60-075795 | A | 4/1985 |
| JP | 60-206998 | A | 10/1985 |
| JP | 61-167354 | A | 7/1986 |
| JP | 05-312157 | A | 11/1993 |
| JP | 11-132164 | A | 5/1999 |
| JP | 11-275824 | A | 10/1999 |
| JP | 11-341752 | A | 12/1999 |
| JP | 2000-161268 | A | 6/2000 |
| JP | 2001-041184 | A | 2/2001 |
| JP | 2002-199670 | A | 7/2002 |
| JP | 2003-35289 | A | 2/2003 |
| JP | 2003-230260 | A | 8/2003 |
| JP | 2004-011473 | A | 1/2004 |
| JP | 2004-060532 | A | 2/2004 |
| JP | 2004-251173 | A | 9/2004 |
| JP | 2004-293492 | A | 10/2004 |
| JP | 2005-188519 | A | 7/2005 |
| JP | 2006-132419 | A | 5/2006 |
| JP | 2006-212746 | A | 8/2006 |
| JP | 2007-187049 | A | 7/2007 |
| JP | 2007-228684 | A | 9/2007 |
| JP | 2008-190444 | A | 8/2008 |
| JP | 2009-097358 | A | 5/2009 |
| JP | 2009-097417 | A | 5/2009 |
| JP | 2009-162078 | A | 7/2009 |
| JP | 2009-243363 | A | 10/2009 |
| JP | 2009-293589 | A | 12/2009 |
| JP | 2011-047343 | A | 3/2011 |

OTHER PUBLICATIONS

Written Opinion dated Mar. 19, 2012, issued in corresponding application No. PCT/JP2011/079464.
Japanese Office Action dated Oct. 7, 2014, issued in Japanese Patent Application No. 2011-067051 with English Machine Translation (7 pages).
Japanese Office Action dated Oct. 7, 2014, issued in Japanese Patent Application No. 2011-071324 with English Machine Translation (7 pages).
Japanese Office Action dated Oct. 7, 2014, issued in Japanese Patent Application No. 2011-071495 with English Machine Translation (6 pages).
Office Action dated Apr. 27, 2015 issued in counterpart Chinese application No. 201180069296.7, with English translation. (20 pages).
Office Action dated Apr. 28, 2015 issued in counterpart Chinese application No. 201180069440.7, with English translation. (18 pages).
Office Action dated May 6, 2015 issued in counterpart Chinese application No. 201180069287.8 , with English translation. (27 pages).
Office Action dated May 26, 2015 issued in counterpart Chinese application No. 201180069545.2 , with English translation. (14 pages).
Office Action dated May 28, 2015 issued in counterpart Chinese application No. 201180069472.7, with English translation. (18 pages).
English Translation of the International Preliminary Report on Patentability of PCT/JP2011/079464 mailing date of Oct. 3, 2013, with forms PCT/IB/338, PCT/IB/373 and PCT/ISA/237 (7 pages).
International Search Report issued in PCT/JP2011/079463, mailing date of Mar. 19, 2012, w/English translation.
International Search Report issued in PCT/JP2011/079465, mailing date of Mar. 19, 2012 w/English translation.
International Search Report issued in PCT/JP2011/079466, mailing date of Mar. 19, 2012 w/English translation.
International Search Report issued in PCT/JP2011/079467, mailing date of Mar. 19, 2012 w/English translation.
International Search Report issued in PCT/JP2011/079468, mailing date of Mar. 19, 2012 w/English translation.
International Search Report issued in PCT/JP2011/079469, mailing date of Mar. 19, 2012 w/English translation.

* cited by examiner

SCROLL COMPRESSION DEVICE

TECHNICAL FIELD

The present invention relates to a scroll compression device that supplies lubrication oil to an engagement portion between a fixed scroll and a swing scroll and performs compression through the engagement between the fixed scroll and the swing scroll.

BACKGROUND ART

There has been hitherto known a scroll compression device that has a compression mechanism comprising a fixed scroll and a swing scroll having mutually engageable spiral laps in a hermetically sealed casing and in which the compression mechanism is driven by a driving motor so that the swing scroll makes a circular motion with respect to the fixed scroll without rotating on its own axis, thereby performing compression (see Patent Document 1, for example).

In this type of scroll compression device, low-pressure refrigerant sucked from a suction pipe is compressed in a compression mechanism, and compressed high-pressure refrigerant is discharged to the outside of a casing from a discharge pipe provided to the casing. Lubrication oil is supplied to lubrication sites such as respective sliding portions of the compression mechanism, the engagement portion between the fixed scroll and the swing scroll, etc. The lubrication oil to be supplied is pooled in an oil pool provided at the lower portion of the casing, and lubrication oil which becomes surplus at the lubrication sites is returned to the oil pool by its own weight.

PRIOR ART DOCUMENT

Patent Document

Patent Document 1: JP-A-2004-60532

SUMMARY OF THE INVENTION

Problem to be Solved by the Invention

However, lubrication oil is influenced by flow of rotating high-pressure gas in a space above a driving motor, so that the lubrication oil is difficult to return to the lower side of the driving motor. When a large amount of lubrication oil discharged from the compression mechanism is stocked on the upper surface of the driving motor, the lubrication oil is influenced by the flow of the rotating high-pressure gas, so that the discharge amount of lubrication oil discharged to the outside of the casing may increase.

The present invention solves the problem of the prior art described above, and provides a scroll compression device in which lubrication oil can be easily returned to the lower side of a driving motor.

Means of Solving the Problem

In order to attain the above object, the present invention is characterized in that a scroll compression mechanism for compressing refrigerant and a driving motor that is connected to the scroll compression mechanism through a driving shaft and drives the scroll compression mechanism are accommodated in a casing, the scroll compression mechanism is supported in the casing by a main frame, a stator of the driving motor is supported in the casing by a spacer ring, the driving shaft is connected to a rotor of the driving motor and supported in the casing by a bearing plate, a pickup is connected to an oil supply path extending in an up-and-down direction in the driving shaft, and intercommunication paths through which lubrication oil scraped up by the pickup, passed through the oil supply path and supplied to lubrication sites located above the driving motor is returned to the lower side of the driving motor are provided between the stator and the spacer ring or between the spacer ring and the casing.

According to the present invention, the lubrication oil which becomes surplus at the respective lubrication sites of the scroll compression mechanism and is discharged from the main frame can be returned to the lower side of the driving motor through the intercommunication paths.

In this construction, the upper end of the spacer ring may be lower than the upper end of the stator, and the lubrication oil pool may be formed above the upper end of the spacer ring. Furthermore, the lubrication oil collector for capturing the lubrication oil which is scraped up by the pickup, passed through the oil supply path in the driving shaft, supplied to the respective lubrication sites and then returned through the return oil path provided to the main frame may be provided, and the notches may be provided as the intercommunication paths on the outer periphery of the spacer ring just below the lubrication collector. Furthermore, the driving motor may be a DC driving motor which is driven by an inverter.

Effect of the Invention

According to the present invention, the intercommunication paths for returning, to the lower side of the driving motor, the lubrication oil supplied to the respective lubrication sites located above the driving motor are formed between the stator and the spacer ring or between the spacer ring and the casing. Therefore, the lubrication oil which becomes surplus at the respective sites of the scroll compression mechanism and is discharged from the main frame can be returned to the lower side of the driving motor through the intercommunication paths.

BRIEF DESCRIPTION OF THE INVENTION

MODE FOR CARRYING OUT THE INVENTION

An embodiment according to the present invention will be described with reference to the drawings.

Figure 1:
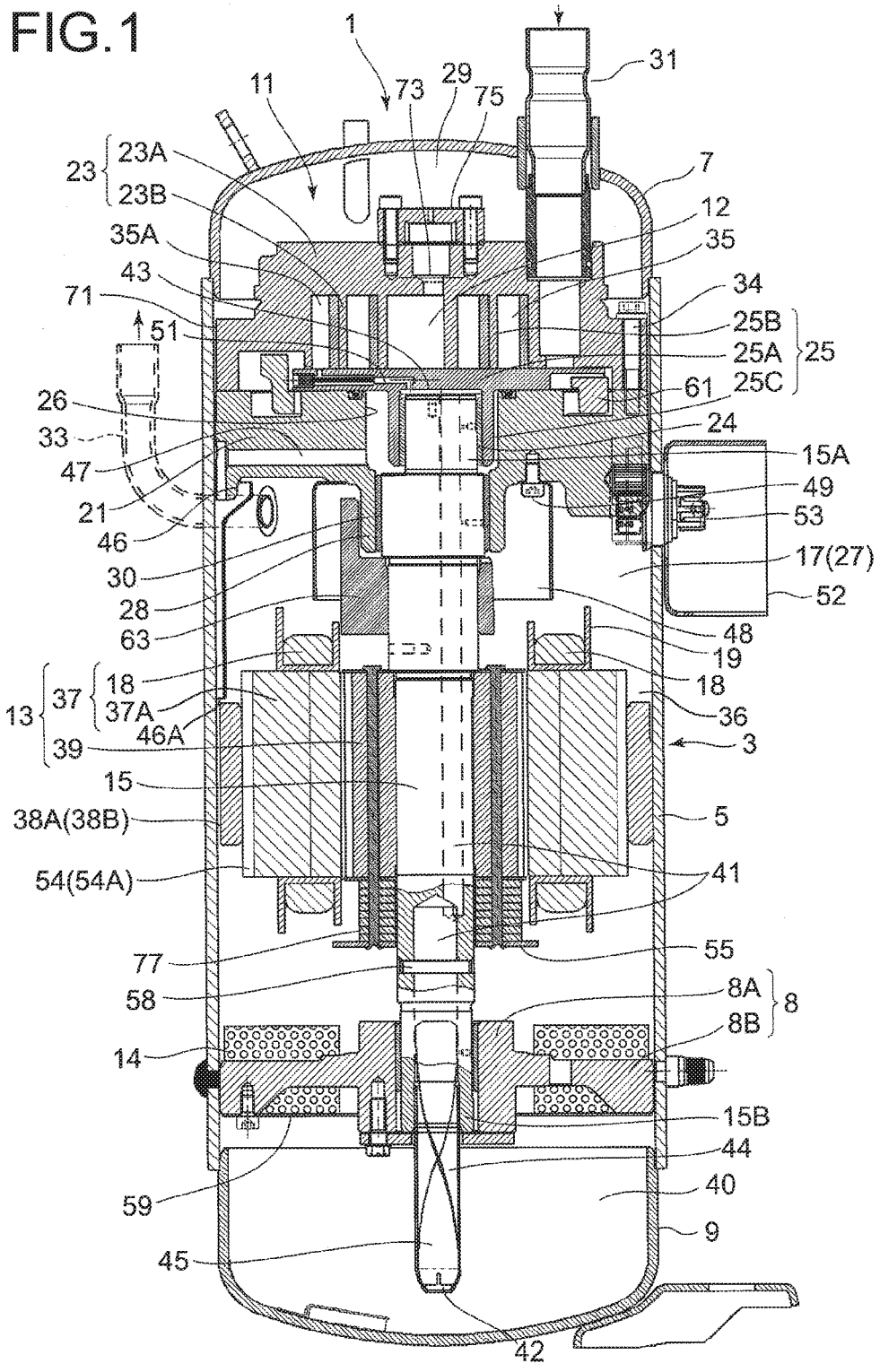
FIG. 1 is a cross-sectional view showing a scroll compression device according to an embodiment of the present invention.

In FIG. 1, reference numeral 1 represents a scroll compression device whose internal pressure is high. The compression device 1 is connected to a refrigerant circuit (not shown) in which refrigerant is circulated to perform a refrigeration cycle operation, and compresses the refrigerant. The compressor 1 has a hermetically-sealed doom type casing 3 having a vertically elongated cylindrical shape.

The casing 3 is configured as a pressure container comprising a casing main body 5 as a cylindrical barrel portion having an axial line extending in the up-and-down direction, a cup-shaped upper cap 7 which is air-tightly welded and integrally joined to the upper end portion of the casing main body 5 and has a convex surface protruding upwards, and a cup-shaped lower cap 9 which is air-tightly welded and integrally joined to the lower end portion of the casing main body 5 and has a convex surface protruding downwards. The inside of the casing 3 is hollow. A terminal cover 52 is provided to the outer peripheral surface of the casing 3, and a power supply terminal 53 for supplying power to a stator 37 described later is provided in the terminal cover 52.

In the casing 3 are accommodated a scroll compression mechanism 11 for compressing refrigerant and a driving motor 13 disposed below the scroll compression mechanism 11. The scroll compression mechanism 11 and the driving motor 13 are connected to each other through a driving shaft 15 which is disposed so as to extend in the up-and-down direction in the casing 3. A gap space 17 is formed between the scroll compression mechanism 11 and the driving motor 13.

A main frame 21 is accommodated at the inner upper portion of the casing 3, and a radial bearing portion 28 and a boss mount portion 26 are formed at the center of the main frame 21. The radial bearing portion 28 pivotally supports the tip (upper end) side of the driving shaft 15, and is configured to project downwards from the center of one surface (lower side surface) of the main frame 21. The boss mount portion 26 is used to accommodate therein a boss 25C of a swing scroll 25 described later, and formed by concaving the center of the other surface (upper side surface) of the main frame 21 downwards. An eccentric shaft portion 15A is formed at the tip (upper end) of the driving shaft 15. The eccentric shaft portion 15A is provided so that the center thereof is eccentric from the shaft center of the driving shaft 15, and inserted through a slewing bearing in the boss 25C so as to be turnably driven.

The scroll compression mechanism 11 comprises a fixed scroll 23 and a swing scroll 25. The fixed scroll 23 is disposed in close contact with the upper surface of the main frame 21. The main frame 21 is secured to the inner surface of the casing main body 5, and the fixed scroll 23 is fastened and fixed to the main frame 21 by a screw 34. The swing scroll 25 is engaged with the fixed scroll 23, and disposed in a swing space 12 formed between the fixed scroll 23 and the main frame 21. The inside of the casing 3 is partitioned into a high-pressure space 27 below the main frame 21 and a discharge space 29 above the main frame 21. The respective spaces 27 and 29 intercommunicate with each other through vertical grooves 71 which are formed on the outer peripheries of the main frame 21 and the fixed scroll 23 so as to extend vertically.

An intake pipe 31 for introducing the refrigerant in the refrigerant circuit to the scroll compression mechanism 11 air-tightly and fixedly penetrates through the upper cap 7 of the casing 3, and a discharge pipe 33 for discharging the refrigerant in the casing 3 to the outside of the casing 3 air-tightly and fixedly penetrates through the casing main body 5. The intake pipe 31 extends in the up-and-down direction in the discharge space 29, and the inner end portion thereof penetrates through the fixed scroll 23 of the scroll compression mechanism 11 and intercommunicates with the compression chamber 35, whereby the refrigerant is sucked into the compression chamber 35 through the intake pipe 31.

The driving motor (DC driving motor) 13 is a DC (Direct Current) motor which is actuated upon an input from a DC power source, and has an annular stator 37 and a rotor 39 which is freely rotatably provided in the stator 37. The driving motor 13 is operated while the rotation torque thereof is controlled by a PWM (Pulse Width Modulation) inverter which receives a constant input voltage and controls the duty ratio of pulse waves, that is, an output period of the pulse waves and the pulse width of the output pulse waves.

The swing scroll 25 of the scroll compression mechanism 11 is operationally connected to the rotor 39 through the driving shaft 15. The stator 37 comprises a stator core 37A and a stator coil 18. The stator core 37A is formed by laminating thin iron plates and has plural grooves (not shown) therein. The stator coil 18 is formed by winding stator windings of plural phases, and provided to be fitted in the grooves formed in the stator core 37A at the upper and lower sides of the stator core 37A. The stator coil 18 is accommodated in an insulator 19. The stator 18 is connected to the power supply terminal 53 through a conductive wire (not shown).

The rotor 39 is magnetized by ferrite magnet or neodymium magnet. As a method of magnetizing the rotor 39 is known a winding magnetizing method of inserting the rotor 39 in the stator 37 and then passing current through stator windings forming the stator coil 18 of the stator 37 to magnetize the rotor 39, or an externally magnetizing method of magnetizing the rotor 39 by using an external magnetizing device and then inserting the rotor 39 in the stator 37. A holder (pin holder) 58 described later in detail is pressed in the driving shaft 15, and used to position the rotor 39 when the winding magnetization of the rotor 39 is performed.

The stator 37 is supported on the inner wall of the casing 3 by an annular spacer ring 38. The spacer ring 38 is fixed to the inner wall surface of the casing 3 by shrinkage fitting, and the stator 37 is fixed to the inner wall surface of the spacer ring 38 by shrinkage fitting. The upper end surface of the spacer ring 38 is provided at a lower position than the upper end surface of the stator 37.

A bearing plate 8 in which the lower end portion of the driving shaft 15 is rotatably fitted and supported is provided below the driving motor 13. The bearing plate 8 has a boss portion 8A into which the cylindrical driving shaft 15 is fitted, and arm portions 8B which are provided at substantially equal intervals on the periphery of the boss portion 8A so as to extend in the four directions and fixed to the casing main body 5. That is, the driving shaft 15 is supported in the casing 3 by the bearing plate 8. The bearing plate 8 has opening portions 8E which are formed among the respective arm portions 8B and through which upper and lower spaces above and below the bearing plate 8 intercommunicate with each other.

As shown in FIG. 1, the lower space (oil pool) 40 below the bearing plate 8 is kept at high pressure, and oil is pooled at the inner bottom portion of the lower cap 9 corresponding to the lower end portion of the lower space 40. An annular plate 59 is provided between the bearing plate 8 and the oil pool 40 so as to be fixed to the bearing plate 8. Furthermore, a baffle plate 14 is provided above the annular plate 59 so as to be supported by the annular plate 59. The baffle plate 14 is formed of thin plate type punching metal having many fine pores, for example.

A oil supply path 41 as a part of high-pressure oil supplying means is formed in the driving shaft 15, and the oil supply path 41 extends vertically in the driving shaft 15 and intercommunicates with an oil chamber 43 at the back side of the swing scroll 25. The oil supply path 41 is connected to an oil pickup 45 provided to the lower end of the driving shaft 15. A lateral hole 57 is provided at the back side of the oil pickup 45 so as to extend in the radial direction of the driving shaft 15 and penetrates through the oil supply path 41. The holder 58 described above is pressed into the lateral hole 57. The oil pickup 45 is pressed into the driving shaft 15 after the rotor 39 is magnetized.

The oil pickup 45 has a suction port 42 provided to the lower end thereof, and a paddle 44 formed above the suction port 42. The lower end of the oil pickup 45 is immersed in lubrication oil pooled in the oil pool 40, and the suction port 42 of the oil supply path 41 is opened in the lubrication oil. When the driving shaft 15 rotates, the lubrication oil pooled in the oil pool 40 enters the oil supply path 41 from the suction port 42 of the oil pickup 45, and is pumped up along the paddle 44 of the oil supply path 41. The thus-pumped lubrication oil is passed through the oil supply path 41, and supplied to the respective sliding portions of the scroll compression mechanism 11 such as the radial bearing portion 28, the slewing bearing 24, etc. Furthermore, the lubrication oil is supplied through the oil supply path 41 to the oil chamber 43 at the back side of the swing scroll 25, and supplied from the oil chamber 43 through an intercommunication path 51 provided to the swing scroll 25 to the compression chamber 35.

The main frame 21 penetrates radially from the boss mount portion 26 through the main frame 21 to form a return oil path 47 opened to the vertical groove 71. Excessive lubrication oil out of the lubrication oil supplied through the oil supply path 41 to lubrication sites such as the respective sliding portions of the scroll compression mechanism 11, the compression chamber 35, etc. is passed through the return oil path 47 and returned to the oil pool 40. An oil collector 46 is provided below the return oil path 47, and the oil collector 46 extends to the neighborhood of the upper end of the spacer ring 38. Plural notches 54 are formed on the outer peripheral surface of the stator 37 so as to extend between the upper and lower sides of the stator 37. The lubrication oil returned from the oil supply path 41 through the return oil path 47 and the oil collector 46 is passed through the gap between the notches 54 and the gap between the respective arm portions 8B and returned to the oil pool 40. In the cross-sectional view of FIG. 1, the discharge pipe 33 is represented by broken lines for the purpose of simplification of description, but the discharge pipe 33 is disposed to be displaced in phase from the oil collector 46.

The fixed scroll 23 comprises an end plate 23A and a spiral (involute type) lap 23B formed on the lower surface of the end plate 23A. The swing scroll 25 comprises an end plate 25A and a spiral (involute type) lap 23B formed on the upper surface of the end plate 25A. The lap 23B of the fixed scroll 23 and the lap 25B of the swing scroll 25 are engaged with each other, whereby plural compression chambers 35 are formed between the fixed scroll 23 and the swing scroll 25 by both the laps 23B, 25B.

The swing scroll 25 is supported by the fixed scroll 23 through an Oldham's ring 61, and a cylindrical boss 25C having a bottom is provided to the center portion of the lower surface of the end plate 25A so as to protrude from the center portion. Furthermore, the eccentric shaft portion 15A is provided to the upper end of the driving shaft 15, and the eccentric shaft portion 15A is rotatably fitted in the swing scroll 25.

Furthermore, a counter weight portion (upper balancer) 63 is provided to the driving shaft 15 below the main frame 21, and a lower balancer 77 is provided to the lower portion of the rotor 39. The driving shaft 15 keeps dynamic balance with the swing scroll 25, the eccentric shaft portion 15A, etc. by the upper balancer 63 and the lower balancer 77. The driving shaft 15 rotates with keeping weight balance by the counter weight portion 63 and the lower balancer 77, whereby the swing scroll is made to make an orbital motion. In connection with the orbital motion of the swing scroll 25, the compression chamber 35 is configured to compress refrigerant sucked through the suction pipe 31 by contraction of the volume between both the laps 23B, 25B to the center. A regulation plate 55 which is swaged integrally with the rotor 39 and the lower balancer 77 is provided to the lower surface of the lower balancer 77. The regulation plate 55 will be described in detail later, and is used to regulate the rotation of the rotor 39 when the windings of the rotor 39 are magnetized.

A cup 48 is fixed to the lower side of the main frame 21 by a bolt 49 so as to surround the periphery of the counterweight portion 63. The cup 48 prevents the lubrication oil leaking from the clearance between the main frame 21 and the driving shaft 15 from scattering to the discharge pipe side due to rotation of the counterweight portion 63.

A discharge hole 73 is provided to the center portion of the fixed scroll 23, and gas refrigerant discharging from the discharge hole 73 passes through a discharge valve 75, discharges to the discharge space 29, and then flows out through the vertical grooves 71 provided on the outer peripheries of the main frame 21 and the fixed scroll 23 to the high-pressure space 27 below the main frame 21. This high-pressure refrigerant is discharged to the outside of the casing 3 through the discharge pipe 33 provided to the casing main body 5.

The driving operation of the scroll compression device 1 will be described.

When the driving motor 13 is actuated, the rotor 39 rotates with respect to the stator 37, whereby the driving shaft 15 rotates. When the driving shaft 15 rotates, the swing scroll 25 of the scroll compression mechanism 11 makes only an orbital motion around the fixed scroll 23 without making autorotation. Accordingly, low-pressure refrigerant is passed through the suction pipe 31 and sucked from the peripheral edge side of the compression chamber 35 into the compression chamber 35. This refrigerant is compressed due to the volumetric change of the compression chamber 35, and this compressed refrigerant becomes high-pressure and is discharged from the compression chamber 35 through the discharge valve 75 to the discharge space 29, and then flows out through the vertical grooves 71 provided on the respective outer peripheries of the main frame 21 and the fixed scroll 23 to the high-pressure space 27 below the main frame 21. This high-pressure refrigerant is discharged to the outside of the casing 3 through the discharge pipe 33 provided to the casing main body 5. The refrigerant discharged to the outside of the casing 3 is circulated in the refrigerant circuit (not shown), sucked through the suction pipe 31 into the compressor and compressed again. The circulation of the refrigerant described above is repeated.

The flow of the lubrication oil will be described. The lubrication oil pooled at the inner bottom portion of the lower cap 9 in the casing 3 is scraped up by the oil pickup 45, passed through the oil supply path 41 of the driving shaft 15 and supplied to the respective sliding portions of the scroll compression mechanism 11 and the compression chamber 35. The excessive lubrication oil at the lubrication sites such as the respective sliding portions of the scroll compression mechanism 11 and the compression chamber 35 is collected from the return oil path 47 to the oil collector 46.

The lower end 46A of the oil collector 46 extends to the neighborhood of the upper end of the spacer ring 38. The upper end of the spacer ring 38 is disposed to be lower than the upper end of the stator 37. Accordingly, a lubrication oil pool 36 is formed above the upper end of the spacer ring 38 due to the difference in height between the upper end of the stator 37 and the upper end of the spacer ring 38.

According to this construction, the lubrication oil passed through the return oil path 47 and discharged from the main frame 21 is stocked in the lubrication oil pool 36, and thus the lubrication oil can be prevented from being pooled at the outer peripheral portion of the upper surface of the stator 37. The lubrication oil stocked in the lubrication oil pool 36 is hardly influenced by the flow of high-pressure gas rotating in the high-pressure space 27. Accordingly, the lubrication oil can be prevented from being stocked at the outer peripheral portion of the upper surface of the stator 37 and influenced by the flow of the high-pressure gas rotating in the high-pressure space and thus hardly returning through the intercommunication path 54 to the lower side of the driving motor 13. Furthermore, the lubrication oil can be prevented from being pooled at the outer peripheral portion of the upper surface of the stator 37. Therefore, the lubrication oil pooled at the outer peripheral portion of the upper surface of the stator 37 can be prevented from being influenced by the flow of the high-pressure gas rotating in the high-pressure space 27 and thus discharged from the discharge pipe 33. Therefore, the discharge amount of the lubrication oil can be reduced.

First intercommunication paths (intercommunication paths) 54A through which the spaces above and below the driving motor 13 intercommunicate with each other are formed between the stator 37 and the spacer ring 38 by the notches 54 provided to the stator 37. One or plural notches 38A extending over the upper and lower sides of the spacer ring 38 are formed on the outer periphery of the spacer ring 38. A second intercommunication path (intercommunication path) 38B through which the spaces above and below the driving motor 13 intercommunicate with each other is formed between the spacer ring 38 and the casing 3 by the notch (notches) 38A. The lubrication oil pool 36 intercommunicates with the first intercommunication paths 54A and the second intercommunication path 38B, and the lubrication oil stocked in the lubrication oil pool 36 is passed through the first intercommunication paths 54A or the second intercommunication path(s) 38B and then returned to the lower side of the driving motor 13.

Figure 2:
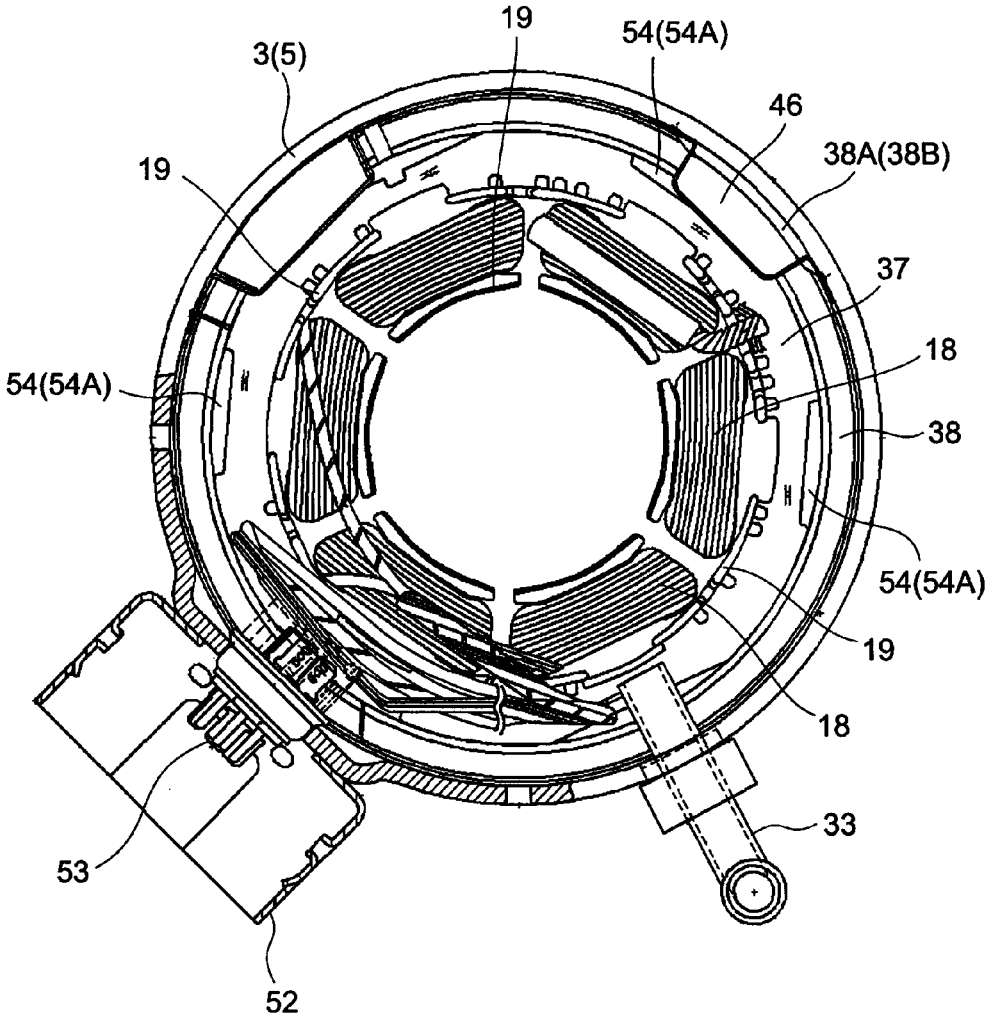
FIG. 2 is a plane cross-sectional view of the scroll compression device.

FIG. 2 is a plane cross-sectional view when the scroll compressor device is cross-sectioned at the upper side of the driving motor 13, and the driving shaft 15 and the rotor 39 are not shown in FIG. 2.

As shown in FIG. 2, the plural first intercommunication paths 54A are formed between the stator 37 and the spacer ring 38 so as to be spaced from one another in the peripheral direction of the stator. The second intercommunication path (s) 38B formed between the spacer ring 38 and the casing 3 is provided just below the oil collector 46. According to this construction, the lubrication oil which is passed through the return oil path 47, discharged from the main frame 21 and passed through the oil collector 46 can be returned through the first intercommunication paths 54A to the lower side of the driving shaft 13. Furthermore, the lubrication oil passing through the oil collector 46 can be positively returned to the lower side of the driving shaft 13 through the second intercommunication path(s) 38B provided just below the oil collector 46.

As described above, according to the embodiment to which the present invention is applied, the scroll compression mechanism 11 for compressing refrigerant and the driving motor 13 which is connected to the scroll compression mechanism 11 through the driving shaft 15 and drives the scroll compression mechanism 11 are accommodated in the casing 3 by the main frame 21, the scroll compression mechanism 11 is supported in the casing 3, the stator 37 of the driving motor 13 is supported in the casing 3 by the spacer ring 38, the driving shaft 15 is connected to the rotor 39 of the driving motor 15, the driving shaft 15 is supported in the casing 3 by the bearing plate 8, the pickup 45 is connected to the oil supply path 41 extending in the up-and-down direction in the driving shaft 15, and the intercommunication paths 38B, 54A for returning, to the lower side of the driving motor 13, the lubrication oil scraped up by the pickup 45, passed through the oil supply path 41 and supplied to the respective lubrication sites located above the driving motor 13 are formed between the stator 37 and the spacer ring 38 or between the spacer ring 38 and the casing 3. Accordingly, the lubrication oil which becomes surplus at the lubrication sites such as the respective sliding portions of the scroll compression mechanism 11, the compression chamber 35, etc. and discharged from the main frame 21 through the return oil path 47 can be positively returned through the intercommunication paths 38B, 54A to the lower side of the driving motor 13. Therefore, a large amount of lubrication oil can be prevented from being stocked above the driving motor, and thus the discharge amount of lubrication oil which is discharged from the discharge pipe 33 due to the influence of the flow of high-pressure gas rotating in the high-pressure space 27 can be reduced.

Furthermore, according to the embodiment to which the present invention is applied, the upper end of the spacer ring 38 is lower than the upper end of the stator 37, and thus the lubrication oil pool 36 is formed above the upper end of the spacer ring 38. Therefore, the lubrication oil passed through the return oil path 47 and discharged from the main frame 21 is hardly influenced by the flow of the high-pressure gas rotating in the high-pressure space 27, so that the lubrication oil can be stocked in the lubrication oil pool 36, and the lubrication oil can be prevented from being stocked at the outer peripheral portion of the upper surface of the stator 37. Accordingly, the lubrication oil can be prevented from hardly returning to the lower side of the driving motor 13 due to the influence of the flow of the high-pressure gas rotating in the high-pressure space 27. Furthermore, since the lubrication oil can be prevented from being stocked at the outer peripheral portion of the upper surface of the stator 37, influenced by the flow of the high-pressure gas rotating in the high-pressure space 27 and thus discharged from the discharge pipe 33, the discharge amount of the lubrication oil can be reduced.

Still furthermore, the embodiment to which the present invention is applied is provided with the oil collector 46 for capturing the lubrication oil which is scraped up by the pickup 45, passed through the oil supply path 41 in the driving shaft 15, supplied to the respective lubrication sites and then returned through the return oil path 47 provided to the main frame 21, and also provided with the notches 38A as the intercommunication paths on the outer periphery of the spacer ring 38 just below the oil collector 46. Accordingly, the lubrication oil passed through the return oil path 47, discharged from the main frame 21 and passed through the oil collector 46 can be positively returned to the lower side of the driving motor 13 through the second intercommunication path(s) 38B which are formed between the spacer ring 38 and the casing 3 just below the oil collector 46 by the notch(es) 38A. Therefore, the lubrication oil can be prevented from being stocked at the outer peripheral portion of the upper surface of the stator 37, and also from being discharged from the discharge pipe 33 due to the influence of the flow of the high-pressure gas rotating in the high-pressure space 27, so that the discharge amount of the lubrication oil can be reduced.

Still furthermore, according to the embodiment to which the present invention is applied, the driving motor 13 is a DC driving motor which is driven to be controlled in rotation torque by a PWM inverter. Therefore, the driving motor 13 can be miniaturized by using a driving motor having a high output efficiency. Furthermore, occurrence of needless heat caused by increase/decrease of the voltage of the driving motor 13 can be prevented by driving the driving motor with an inverter, so that the driving efficiency can be enhanced.

DESCRIPTION OF REFERENCE NUMERALS

1 scroll compression device
3 casing
11 scroll compression mechanism
13 driving motor (DC driving motor)
21 main frame
37 stator
38 spacer ring
38A notch
38B second intercommunication path (intercommunication path)
39 rotor
41 oil supply path
45 pickup (oil pickup)
46 oil collector (lubrication oil collector)
54 notch
54A first intercommunication path (intercommunication path)

The invention claimed is:

1. A scroll compression device comprising a scroll compression mechanism for compressing refrigerant and a driving motor that is connected to the scroll compression mechanism through a driving shaft and drives the scroll compression mechanism, wherein:

the scroll compression mechanism and the driving motor are accommodated in a casing;

the scroll compression mechanism is supported in the casing by a main frame;

a stator of the driving motor is supported in the casing by a spacer ring;

the driving shaft is connected to a rotor of the driving motor and supported in the casing by a bearing plate;

a pickup is connected to an oil supply path extending in an up-and-down direction in the driving shaft;

an upper end of the spacer ring is placed below an upper end of the stator to pool a lubrication oil above the upper end of the spacer ring;

a lubrication oil collector that is configured to capture the lubrication oil which is pumped up by the pickup, passed through the oil supply path in the driving shaft, and supplied to the sliding portions of the scroll mechanism is provided;

a lower end of the lubrication oil collector is extended below the upper end of the stator close to the upper end of the spacer ring to guide the lubrication oil;

intercommunication paths through which the lubrication oil collected above the upper end of the spacer ring through the lubrication oil collector to create a pool of the lubrication oil is returned to the lower side of the driving motor are provided between the stator and the spacer ring or between the spacer ring and the casing.

2. The scroll compression device according to claim 1, wherein the driving motor is a DC driving motor driven by an inverter.

* * * * *